United States Patent [19]

Gilhaus

[11] Patent Number: 4,829,758

[45] Date of Patent: May 16, 1989

[54] APPARATUS FOR SPLICING AND ENTWINING FIBER SLIVERS

[75] Inventor: Konrad F. Gilhaus, Bielefeld, Fed. Rep. of Germany

[73] Assignee: Spinnereimaschinenfabrik Seydel & Co. GmbH, Bielefeld, Fed. Rep. of Germany

[21] Appl. No.: 149,731

[22] Filed: Jan. 29, 1988

[30] Foreign Application Priority Data

Apr. 18, 1987 [DE] Fed. Rep. of Germany ..... 3713285

[51] Int. Cl.[4] ..... B65H 69/06; D02J 1/08

[52] U.S. Cl. ..... 57/22; 19/157; 28/276; 57/350

[58] Field of Search ..... 57/22, 23, 350, 333, 57/261; 28/271-276; 19/150, 157

[56] References Cited

U.S. PATENT DOCUMENTS

| | | | |
|---|---|---|---|
| 3,277,537 | 10/1966 | Roeder et al. | 19/150 X |
| 3,380,135 | 4/1968 | Wood et al. | 57/22 |
| 3,581,486 | 6/1971 | Dibble | 57/22 |
| 3,619,868 | 11/1971 | Dibble | 28/276 X |
| 4,005,566 | 2/1977 | Hawkins | 57/350 |

FOREIGN PATENT DOCUMENTS 3247687 6/1984 Fed. Rep. of Germany .

*Primary Examiner*—John Petrakes

*Attorney, Agent, or Firm*—Becker & Becker, Inc.

[57] ABSTRACT

A combination apparatus for splicing and entwining fiber slivers. A nozzle support arrangement for the nozzles of a splicing mechanism is provided and comprises essentially round rods that are adapted to be disposed horizontally one above another, with the nozzles of the splicing mechanism opening on the surfaces of the rods via nozzle outlets that are surrounded by respective raised portions of the rods. A guide mechanism is provided downstream of the splicing mechanism for converting and bringing the fiber slivers into a flat sliver shape. The guide mechanism comprises the lowermost one of the horizontal rods, upon which the fiber slivers rest, plus two vertical guide rods that are disposed to the sides. Disposed downstream of the guide mechanism is a sliver funnel in which are successively disposed at least two pairs of further nozzles. These nozzle pairs are disposed at a distance from one another and in a crosswise manner relative to each other, with the nozzles of each pair of further nozzles being directed in opposed directions and being adapted to be supplied with compressed air.

17 Claims, 7 Drawing Sheets

1
5
21
20
19
18
1
31
24
26
25
23
22
3
28
24
V
V
19
20
17
26
25
28
27
27
27
27
A

APPARATUS FOR SPLICING AND ENTWINING FIBER SLIVERS

BACKGROUND OF THE INVENTION

The present invention relates to a combination apparatus for selectively splicing the ends of fiber slivers, or entwining or interweaving fiber slivers, in conjunction with stretch-break converting machines, cut converting machines, carding, drawing, etc. The apparatus includes a splicing mechanism having one or more pairs of nozzles that are disposed on a pair of nozzle supports in such a way that the nozzles are spaced from one another and are directed in opposed directions, with the nozzles being adapted to be supplied with compressed air, and with splicing of the ends of the fiber slivers being effected by aerodynamic turbulence. The apparatus also includes an entwining or interweaving mechanism that is disposed downstream of the splicing mechanism and has a sliver funnel that has a tapering cross-sectional transport surface, with the fiber sliver, which comprises individual fibers that are oriented essentially parallel to one another, being guided through the sliver funnel.

Manmade fibers are produced as endless filaments or tows that have a high degree of uniformity. Subsequently, for further processing in a secondary spinning mill, the filaments or tows, in conformity with their intended application, are cut to the desired fiber length or are stretch-break converted or cut converted. Whereas the cut fiber material, which is present in a random orientation, must subsequently be disentangled and carded or crimped to again draw the fibers and make them parallel, as well as to manufacture the fiber sliver, during stretch-break converting the excellent parallel orientation of the fibers in the fiber slivers, and the high degree of uniformity of the tow, is maintained.

Preparatory machines in fiber yarn spinning mills have the task of supplying a continuous fiber sliver that is generally placed in canisters and is supplied to subsequent spinning machines as needed. These preparatory machines include carding machines, crimping machines, stretch-break converting machines, cut converting machines, combing machines, drawing machines, etc. Machines that are supplied with fiber slivers include, for example, flyers, finishers, rubbing finishers, roving machines, armature-type spinning machines, ring-type spinning machines, etc.

The fiber slivers manufactured from the fiber tows in stretch-break converting machines must be adequately held together in order to be transported and further processed. In many instances this holding-together is ensured by the sliver structure, fiber crimping, finishing, etc. In certain cases additional measures are undertaken, for example by concentrating the slivers, crimping the fibers, applying coatings, by the false twist process, etc., in order in this way to improve the holding-together of the fiber slivers. However, even these measures are not always sufficient to assure the required holding-together of the fiber slivers due to the nature of the untreated material and/or for technological reasons.

For example, when stretch-break converting certain untreated materials, the latter cause difficulties in the further processing of the fiber slivers that are placed in canisters. Due to inadequate holding-together of the sliver, the fiber slivers cannot be reliably withdrawn from the canisters. If the fiber sliver splits along its length, the two sliver portions experience different tensions during withdrawal from the canister. The sliver that remains in the canister is suddenly completely withdrawn after a certain period of time. Appropriate control devices then become operative, and bring about a stoppage of production. In addition, expensive waste results.

Similarly, via the cut converting process, fiber groups are produced that after being combined to form a fiber sliver assure an only inadequate holding-together of the sliver. This drawback can be eliminated only by passing through the draw frame a number of times. In particular the supplying of the fiber sliver during high production speeds causes difficulties, elimination of which required the development of expensive and complicated sliver-guiding elements.

Finally, in cotton-combing machines, the high degree of parallel orientation of the fibers due to the combing process reduces the fiber adhesion in the fiber sliver. This can result in stoppages of production in the subsequent draw frames.

Furthermore, breaking of the fiber sliver occurs during all handling processes; these breaks can be corrected by manually connecting the ends of the fiber slivers. In other cases, for example during the delivery of the fiber slivers, it is not uncommon to dispense with a connection of the fiber slivers when breakage occurs, so that the correction of the sliver break is put off until the next processing stage. The quality of manually produced sliver connections depends upon the skill and reliability of the operating personnel. In practice frequently connections are made that are too weak and break again, or connections are made that are too strong and that lead to yarn error during the course of the further processing. The necessity for a manual intervention when the sliver breaks furthermore interferes with the endeavors for further automating the production of textiles.

For this reason, an apparatus was proposed in German Offenlegungsschrift No. 32 47 687 to mechanically produce splice connections between the ends of fiber slivers. This known splicing apparatus is predominantly used on stretch-break converting machines, cut converting machines, and for drawing. With this known apparatus, the splicing of the fiber sliver ends is effected by an aerodynamic turbulence, with one or more pairs of nozzles being provided. These nozzle pairs are spaced from one another, are directed in opposed directions, and are disposed on respective nozzle supports; compressed air is supplied to the nozzles. By means of the aerodynamic turbulence, a definite, secure, and neutral-quality connection of the fiber sliver ends is obtained.

With the heretofore known splicing apparatus, it is necessary to supply compressed air at between 2.5 and 7 bar. This range is in conformity with experience, which shows that secure splice connections of fiber slivers require a relatively high compressed air pressure. Of course, such a high air pressure necessitates a high consumption of energy. Furthermore, the air pressure cannot be increased at liberty, so that the heretofore known splicing apparatus cannot be used for those applications where an extremely high air pressure is required, for example for splicing specialty fibers, such as metal fibers, where an increased splicing action is necessary.

A particular problem with the heretofore known splicing and entwining devices is that the latter cannot be integrated together in an appropriate machine because they require too much space, so that they must always be disposed separate from one another.

Proceeding from the above, it is an object of the present invention to provide a combination apparatus for selectively splicing the ends of fiber slivers, or entwining fiber slivers, with such a combination apparatus requiring only little space, with the splicing mechanism of this combination apparatus being embodied in such a way that a splice connection can be produced at low air pressure, and with the entwining mechanism of the combination apparatus being embodied in such a way that with it an improved adhesion of the fiber slivers, and a nonproblematic transport or further processing of the fiber slivers is possible.

BRIEF DESCRIPTION OF THE DRAWINGS

This object, and other objects and advantages of the present invention, will appear more clearly from the following specification in conjunction with the accompanying schematic drawings, in which:

FIG. 9*a'* is a cross-sectional view through the rod portion illustrated in FIG. 9*a*;

FIG. 9*b'* is a cross-sectional view through the rod portion illustrated in FIG. 9*b*;

FIG. 9*c'* is a cross-sectional view through the rod portion illustrated in FIG. 9*c;*

SUMMARY OF THE INVENTION

Figure 1:
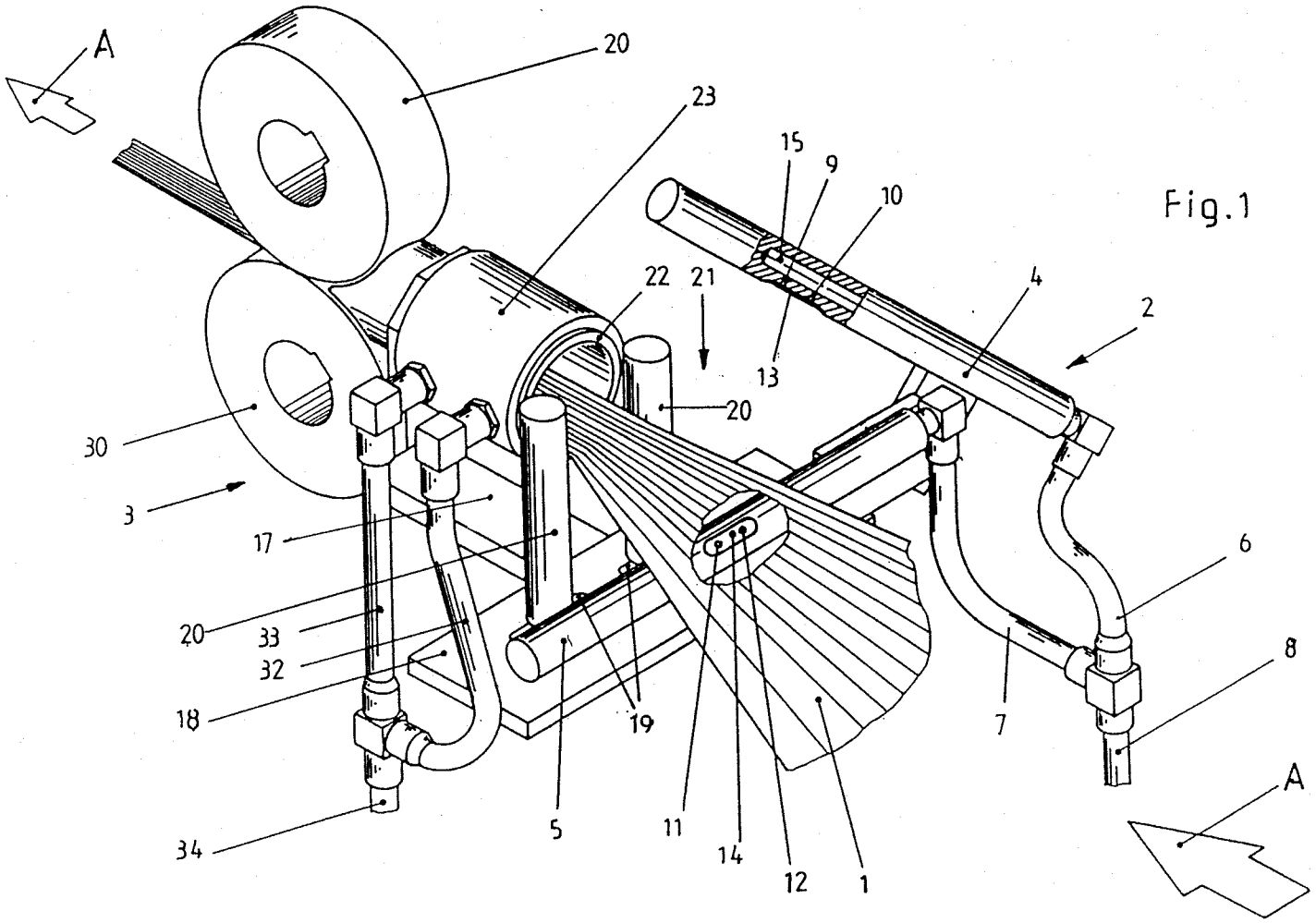
FIG. 1 is a view of one exemplary embodiment of the inventive combination apparatus, showing a splicing mechanism as well as an entwining mechanism that is disposed downstream of the splicing mechanism.

The combination apparatus of the present invention for selectively splicing the ends of fiber slivers, or entwining fiber slivers, is characterized primarily in that: the nozzle support arrangement of the splicing mechanism comprises essentially round rods (splicing members) that are adapted to be disposed horizontally one above another, with the nozzles of the splicing mechanism opening on the surfaces of the rods via nozzle outlets that are surrounded by respective raised portion means of the rods; a guide mechanism is disposed upstream of the sliver funnel of the entwining mechanism for converting and bringing the fiber slivers into a flat sliver shape, with the guide mechanism comprising the lowermost one of the horizontal rods, upon which the fiber sliver rests, plus two vertical guide rods that are disposed to the sides; and at least two pairs of further nozzles that are successively disposed in the sliver funnel and a distance from one another and in a crosswise manner relative to each other, with the nozzles of each pair of further nozzles being directed in opposed directions and being adapted to be supplied with compressed air.

A particular advantage of the inventive apparatus is that the splicing mechanism is integrated in the entwining mechanism or, vice versa, the entwining mechanism is integrated in the splicing mechanism, so that this combination apparatus requires very little space and can therefore be mounted as a single apparatus on the appropriate machine at the same location, thus considerably simplifying handling use. Thus in a limited space it is possible to reliably carry out not only a splicing of the ends of the fiber slivers but also an entwining of fiber slivers, without thereby being restrained by restricted space conditions. It is therefore now possible to have an improved use of the two mechanisms together. Furthermore, the operations of both the splicing mechanism and the entwining mechanism are improved relative to what was possible with the heretofore known apparatus.

The raised portion of the rods that surrounds the nozzle outlets has the advantage of improving the action of the air jets. This is true because due to the raised portion on one rod, the air jets, after passing through the fiber sliver, are concentrated and reflected on the opposing rod, the nozzles of which are also surrounded by a raised portion. Thus, the directed air jets pass through the fiber sliver several times, which considerably improves the action of the air jets. As a result, the air pressure can be reduced without adversely affecting the quality of the splice connection. In addition to reducing the energy consumption by reducing the air pressure, the range of applicability of the splicing mechanism is increased, and even to instances where air is available at only a very low pressure. Furthermore, a splicing mechanism that requires only a reduced air pressure for processing conventional untreated fibers offers reserves for splicing specialty fibers, such as metal fibers, where an increased splicing effect is required and where the operation of the splicing mechanism must be carried out at a higher air pressure; it should be noted, however, this higher air pressure is still within the previous conventional limits when the inventive splicing mechanism is used. A further advantage is that by reducing the air pressure, the splicing mechanism can be readily combined with the entwining mechanism, which requires a similar air pressure for its operation. The nozzle supports in the form of round rods (splicing members) finally have the advantage that the splicing effect that is achieved is more effective than when splicing members having planar surfaces are used, so that with the use of the inventive rods the effect of the air jets is improved still further. Furthermore, the round rods (splicing members) finally have the advantage that the lower rod can serve as part of the guide mechanism of the subsequent entwining mechanism, which can have a very advantageous effect upon the compactness of the overall combination apparatus.

Via the inventive entwining mechanism, a multi-stage, i.e. three-stage, method is made possible for entwining the fiber slivers; this method can be easily integrated into existing processes. First of all, by means of the guide mechanism, the fiber sliver is converted into a configuration that is suitable for the entwining process, namely a flat sliver shape. In the second stage, the fibers or groups of fiber are deflected from the parallel orientation in the sliver funnel, with this second stage being the precondition for the subsequent entwining in the third stage. In this third stage, the already deflected fibers are again deflected, and in particular at right angles to the direction of deflection in the second stage. As a result, an entwining of the twice deflected fibers with the parallel fibers takes place. By means of this entwining, the sliver adhesion of the fiber slivers is considerably improved, as a result of which the fiber slivers that are produced on the one hand permit a nonproblematic withdrawal from storage canisters, and on the other hand the desired fiber sliver structure is affected only temporarily, so that after passing through the conventional draw frames, no undesired adverse effect on the product quality can be ascertained. The entwining process is positively influenced if the fibers from the edge groups of the fiber sliver are deflected and entwined with the parallel fibers.

Further advantageous features of the present invention will be described in detail subsequently with regard to the splicing mechanism, the entwining mechanism, and a preferred air pressure range for operating the splicing and entwining mechanisms.

DESCRIPTION OF PREFERRED EMBODIMENTS

Referring now to the drawings in detail, FIG. 1 shows a combination apparatus for selectively splicing the ends of fiber slivers 1 or entwining or interweaving the fiber sliver 1. This apparatus comprises a splicing mechanism 2, downstream of which is disposed an entwining or interweaving mechanism 3. These mechanisms will be described in detail subsequently not only with regard to their construction, but also with regard to their operation. In this connection, the splicing mechanism 2 is illustrated in FIGS. 2, 3, 9 and 10, and the entwining mechanism 3 is illustrated in FIGS. 4 to 8, whereas FIG. 1 illustrates the combination of these two mechanisms 2, 3 showing their spacial relationship to one another.

Figure 2:
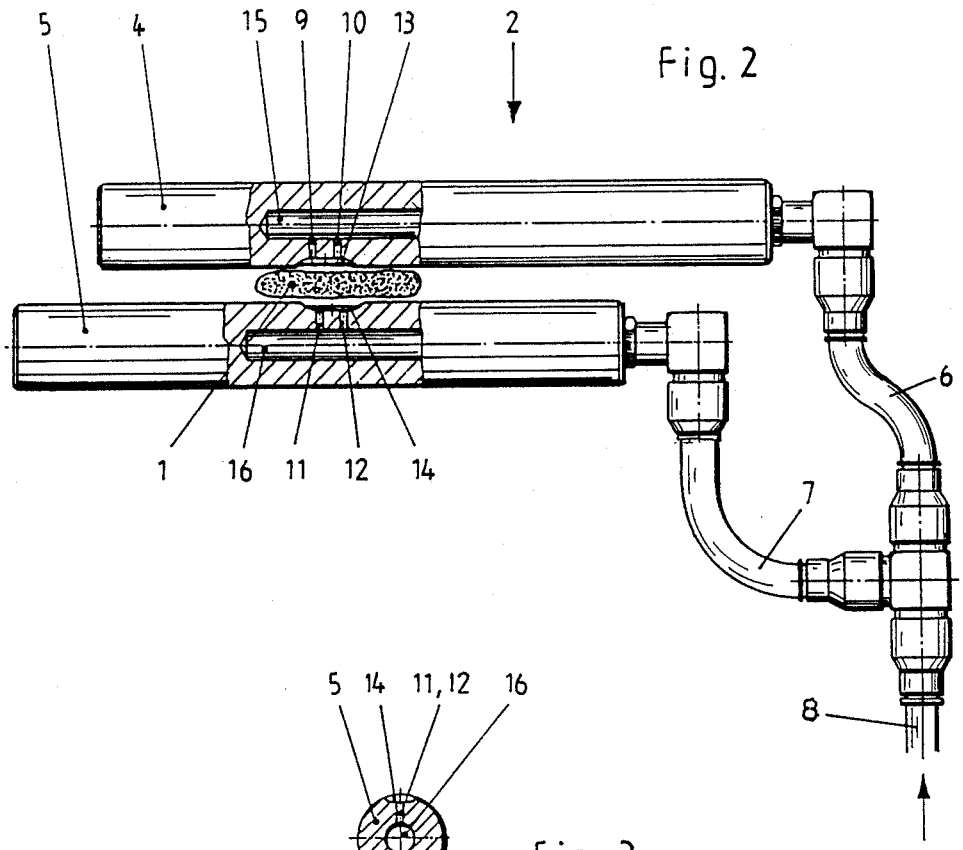
FIG. 2 is a partially cross-sectioned view of the splicing mechanism in the transport direction of the fiber sliver.
Figure 3:
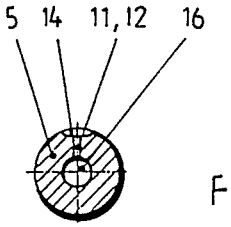
FIG. 3 is a cross-sectional view through the lower splicing member of the splicing mechanism in the region of one of the nozzles thereof.

In the detailed illustration of FIG. 2, it can be seen that the splicing mechanism 2 comprises two nozzle carriers or supports that are embodied as round rods 4, 5 (splicing members), and are disposed horizontally. Defined between these two rods 4, 5 is a gap through which the fiber slivers 1 that are to be spliced are guided in the direction of travel A of the fiber sliver 1. One end of the two rods 4, 5 is connected to a respective air supply line 6, 7, with these lines being supplied with compressed air from a common air supply 8.

Each of the two rods 4, 5 is provided with two nozzles 9, 10 or 11, 12 respectively. The nozzles 9, 11 are directed in opposite directions in order to form a pair of nozzles. The same is true for the two other nozzles 10, 12. The nozzle outlets or orifices of the adjacent nozzles 9, 10 of the upper rod 4 open into a groove or recess 13 in the downwardly directed surface of the rod 4. As can be seen in the cross-sectional view of FIG. 3, the groove 13 is recessed. Thus, the peripheral edge of the groove 13 forms a raised portion that surrounds the nozzle orifices of the nozzles 9, 10, so that these orifices are recessed in the rod 4. The nozzles 11, 12 in the lower rod 5 open into a similar groove or recess 14, so that the nozzle orifices of the nozzles 11, 12 are also recessed in the rod 5, with the edge of the groove 14 forming a raised portion that surrounds these nozzle orifices.

Figure 9A:
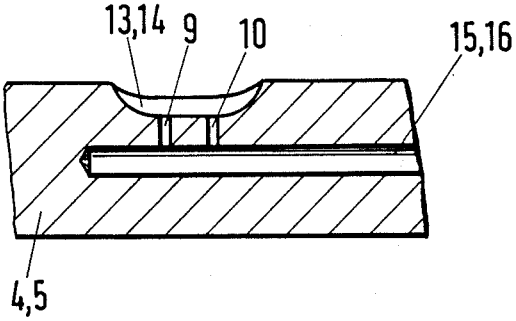
FIG. 9*a* is a longitudinal cross-sectional view through one exemplary embodiment of the grooves or recesses in the rods of the splicing mechanism.
Figure 9A:
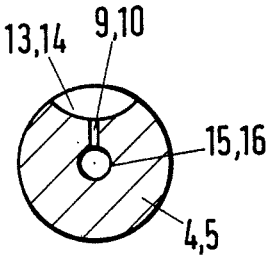
Figure 9B:
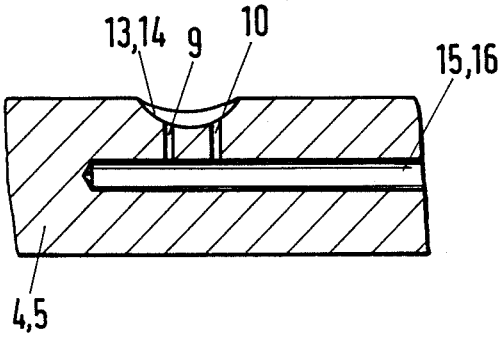
FIG. 9*b* is a longitudinal cross-sectional view through another exemplary embodiment of the grooves or recesses in the rods of the splicing mechanism.
Figure 9B:
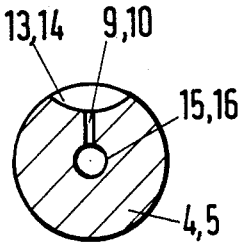
Figure 9C:
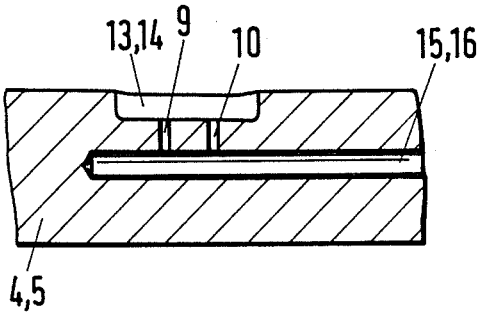
FIG. 9*c* is a longitudinal cross-sectional view through a further exemplary embodiment of the grooves or recesses in the rods of the splicing mechanism.
Figure 9C:
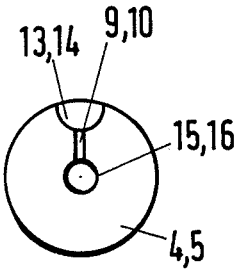

FIGS. 9*a*–9*c* illustrate a few specific embodiments of possible shapes for the grooves or recesses 13, 14 into which the nozzle outlets open. In particular, FIG. 9*a* illustrates a trough-like shape, FIG. 9*b* illustrates a hemispherical shape, and FIG. 9*c* illustrates a groove-like shape.

Figure 10A:
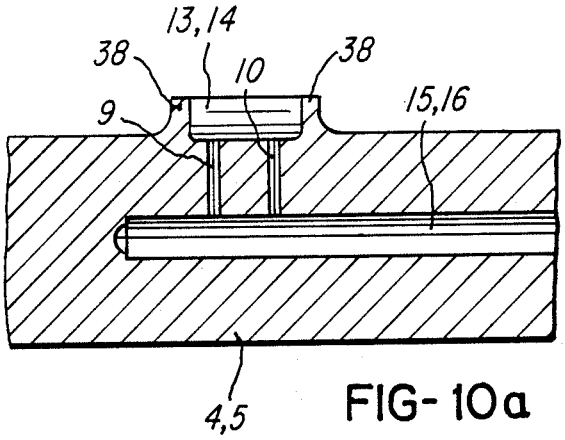
FIG. 10*a* is a longitudinal cross-sectional view through one exemplary embodiment of a raised edge portion on the rods of the splicing mechanism.
Figure 10B:
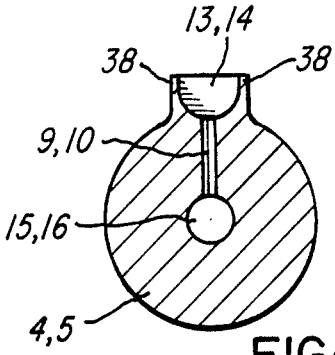
FIG. 10*b* is a cross-sectional view through the rod portion illustrated in FIG. 10*a*.

As shown in the exemplary embodiment of FIGS. 10*a* and 10*b*, the raised peripheral edge portion 38 of the grooves or recesses 13, 14 can actually extend beyond the surface of the rods 4, 5 to surround the nozzle outlets of the nozzles 9–12.

The nozzles 9, 10 and 11, 12 are connected to the air supply lines 6, 7 via air supply channels 15, 16 respectively, with these channels 15, 16 extending axially in the rods 4, 5. The nozzles 9, 10, 11, and 12 proceed in a radial direction from the air supply channels 15, 16 and open into the grooves 13, 14 in the manner previously described.

The splicing mechanism 2 operates as follows:

The two fiber slivers 1 that are to be spliced together are introduced between the two rods 4, 5. For this purpose, the rod 4 is pivotable, as can be seen from FIG. 1, so that the fiber slivers 1 can be more easily introduced.

After the fiber slivers 1 have been introduced, compressed air is supplied to the nozzles 9, 10 and 11, 12 via the air supply 8, the two air supply lines 6, 7 and the two air supply channels 15, 16 in the rods 4, 5. When, for example in connection with the upper rod 4, the compressed air passes through the nozzles 9, 10, the air jets pass through the fiber sliver 1, for which purpose the latter is moved back and forth by an operator. The air jets subsequently strike the opposite rod 5, and hence the groove 14 thereof, where the air jets are concentrated and reflected, so that they again pass through the fiber sliver 1 from the back side and are again concentrated and reflected in the groove 13. This process is repeated several times until the kinetic energy of the air jets is used up for the splicing. The same operating procedure results if the compressed air initially passes through the lower nozzles 11, 12. The effect of the air jets is improved by the concentration, orientation, and reflection thereof, so that the splicing mechanism can be operated with a lower air pressure, and thus with a lower consumption of energy; the splicing quality is not adversely affected by proceeding in this manner.

Figures 4, 5:
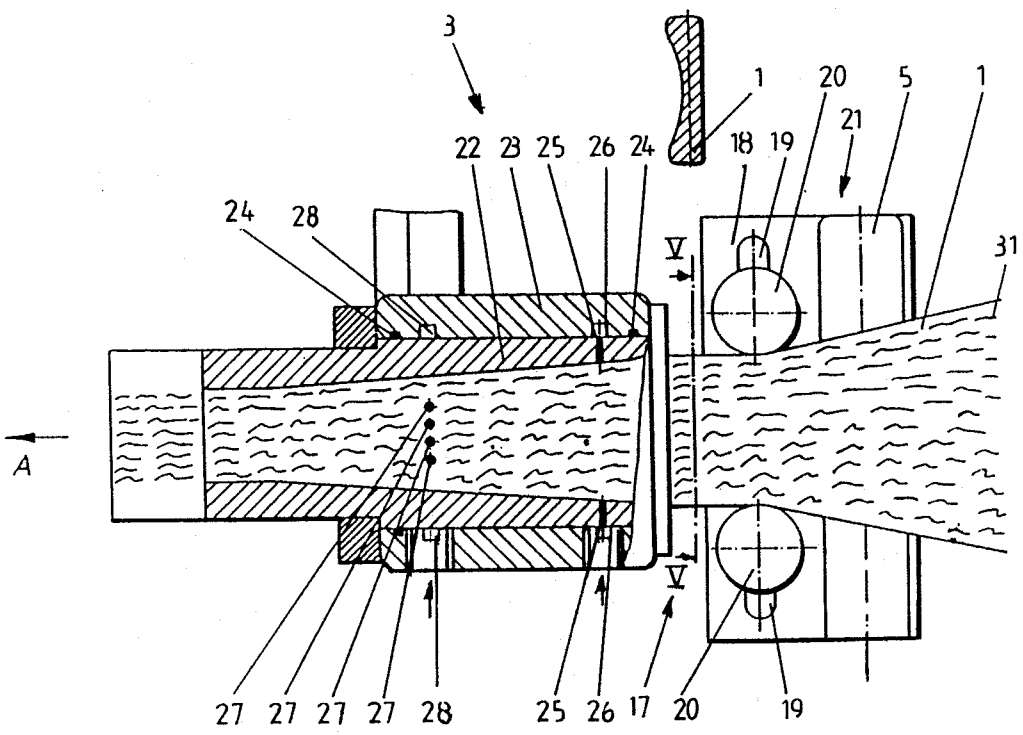
FIG. 4 is a partially cross-sectioned plan view of the entwining mechanism for the fiber slivers.
FIG. 5 is a cross-sectional view taken along the line V—V in FIG. 4 showing the concave cross-sectional shape of the fiber sliver.
Figure 6:
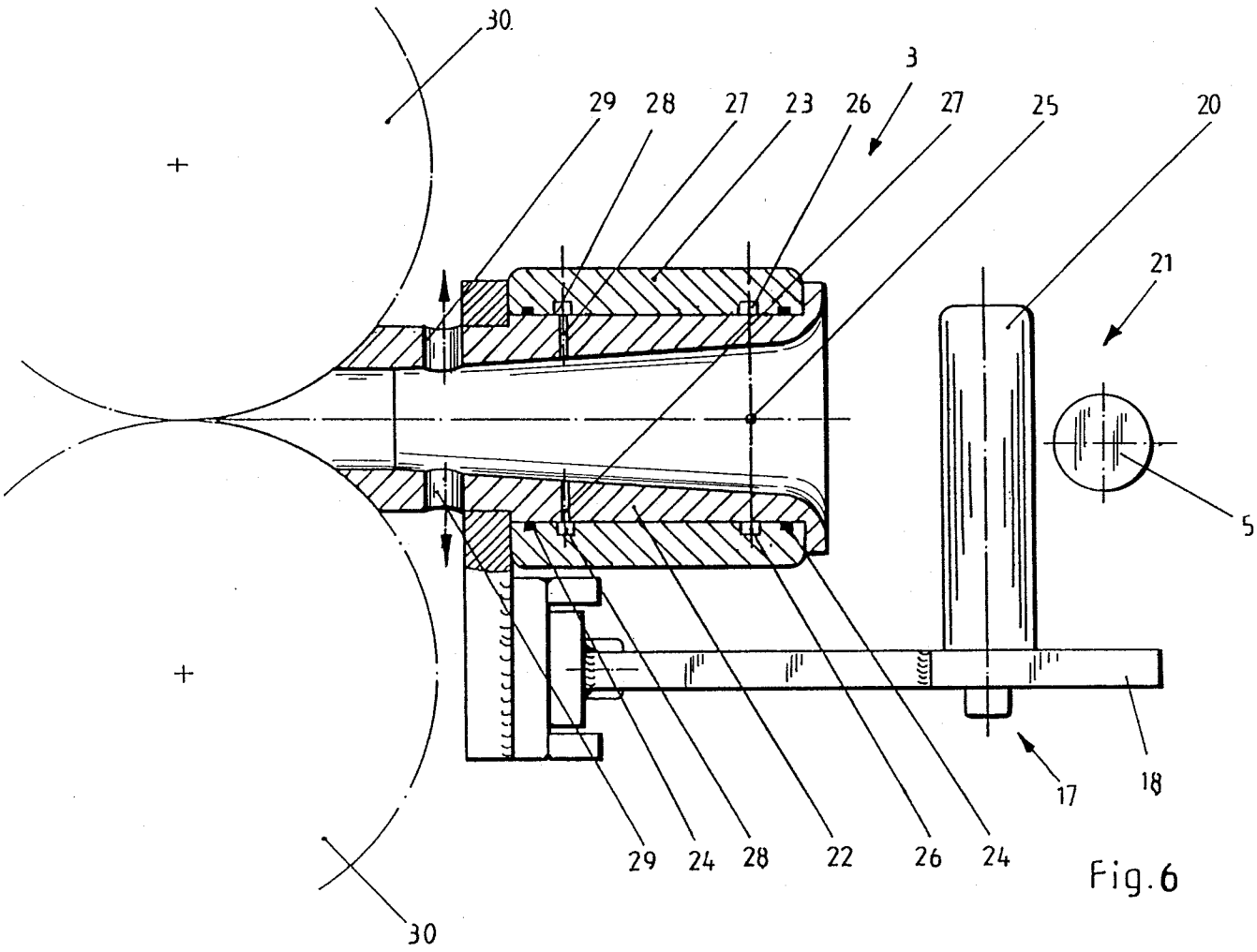
FIG. 6 is a partially cross-sectioned side view of the entwining mechanism of FIG. 4.
Figure 8:
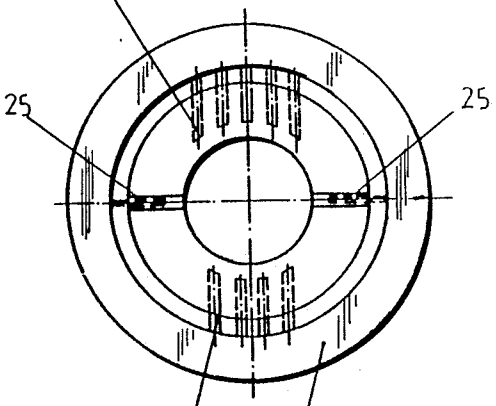
FIG. 8 is a view from the front of the sliver funnel of the entwining mechanism.
Figure 7:
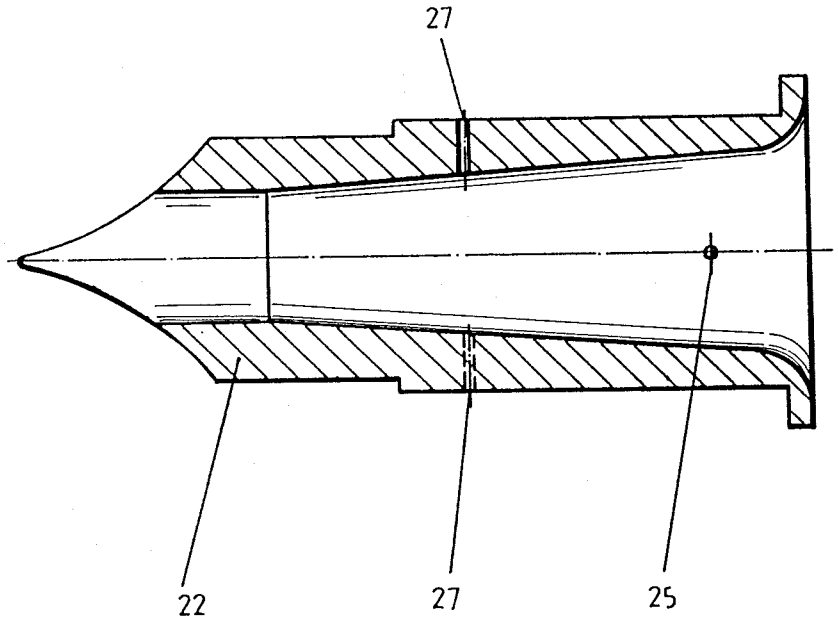
FIG. 7 is a longitudinal cross-sectional view through the sliver funnel of the entwining mechanism.

The overall entwining mechanism 3 for the fiber slivers 1 is illustrated in detail in FIGS. 4 and 6. The entwining mechanism 3 includes a holder 17 via which it can be mounted on a stretch-break converting machine, a cut converting machine, etc. The holder 17 is provided with a horizontal support plate 18 that has two slots 19. Adjustably mounted in each of the two slots 19 of the horizontal support plate 18 is a respective vertical guide rod 20. In conjunction with the lower rod 5 of the splicing mechanism 2, these two guide rods 20 form a guide mechanism 21 for the fiber sliver 1, with the latter resting upon the horizontal rod 5 and being guided through and between the two vertical guide rods 20, which delimit the fiber sliver 1 to the sides.

Disposed after the guide mechanism 21 for the fiber sliver 1, as viewed in the direction of travel A of the fiber sliver, is a sliver funnel 22 that has a tapering cross-sectional transport surface. The sliver funnel 22 is surrounded by an air-guidance sleeve 23, with sealing rings 24 being provided at the ends.

In the vicinity of the greatest cross-sectional area of the sliver funnel 22, on both sides of the direction of travel A of the fiber sliver 1, there is provided a respective nozzle 25, with the two nozzles 25 being directed in opposite directions, and being directed into the interior of the sliver funnel 22. Air is supplied to the nozzles 25 via an annular channel 26 in the air-guidance sleeve 23. Provided in the central portion of the sliver funnel 22, on the upper and lower sides, are further nozzles 27 that are also directed in opposite directions relative to one another. As can be seen in particular in FIG. 8, five nozzles 27 are disposed on the upper side of the sliver funnel 22, and four nozzles 27 are disposed on the underside of the sliver funnel 22, with these nozzles 27 being offset relative to one another. Air is also supplied to the nozzles 27 via an annular channel 28 in the air-guidance sleeve 23. The sliver funnel 22 is also provided with air-outlet bores 29.

Connected after the sliver funnel 22 are draw-off rollers 30 that are hydraulically or resiliently loaded.

The entwining mechanism 3 operates as follows:

The fiber sliver 1 that is to be entwined, and that comprises fibers 31 that are oriented essentially parallel to one another, is conveyed to the guide mechanism 21 in the direction of travel A of the fiber sliver. In so doing, the fiber sliver 1 rests upon the rod 5 of the splicing mechanism 2, so that the fiber sliver 1 is guided in a defined horizontal plane. Due to its own weight, and/or the tension on the fiber sliver 1, the latter assumes a flat shape. Following the horizontal rod 5 are the vertical guide rods 20 that are off to the side and via which the fiber sliver 1 is transformed into a concave cross-sectional shape, such as the shape illustrated in FIG. 5. Since the guide rods 20 can be shifted in the slots 19, the cross-sectional shape of the sliver can be varied accordingly.

The fiber sliver 1 is subsequently passed through the sliver funnel 22. Air is first blown against the fibers 31 of the fiber sliver 1 from the lateral nozzles 25, thus deflecting the fibers in a horizontal direction. In this connection, the air pressure can be between 0.5 and 8 bar, and is preferably between 1 and 4 bar, so that the speed of the air jets is several times greater than the speed of the fiber sliver 1.

When the fibers 31 that have been deflected in a horizontal direction reach the nozzles 27, from which air is blown in a direction disposed at right angles to the air jets coming from the nozzles 25, the fibers 31 are again deflected, but this time in a vertical direction, thus leading to entwining or interweaving with the parallel fibers 31. Since the axes of the oppositely directed nozzles 27 are offset relative to one another, the effect of the oppositely directed air jets is not counteracted, so that it is possible to obtain an optimum action upon the fibers 31. The air that is supplied via the nozzles 25 and 27 is withdrawn via the air-outlet bores 29.

By means of the nozzle pairs 25, 27, which are successively arranged in a crosswise manner, the fibers that are deflected by the air jets are reliably interlaced in the fiber matrix and hence are entwined. After it leaves the sliver funnel 22, the entwined fiber sliver 1 passes into the gripping space between the hydraulically or resiliently loaded draw-off rollers 30. From there, the fiber sliver 1 can be handled further, for example by being placed in a canister.

The compressed air for entwining the fiber slivers 1 can advantageously be enriched with finishing and/or marking agents. The finishing agents facilitate, for example, the further handling of the fiber slivers 1. For example, greater handling speeds can be achieved, processing stoppages can be avoided, and improvements in the quality of the end product can be achieved. The marking dyes facilitate the identification of specific manufacturers during further handling processes. In this connection, air enriched with the finishing and/or marking agents is supplied via the annular channels 26, 28 and via the nozzles 25, 27. Withdrawal of excess air is again effected via the annular channels 26, 28 and via the nozzles 25, 27. Withdrawal of excess air is again effected via the air-outlet bores 29 and hoses that are connected thereto and that can have a vacuum applied to them. Instead of a simultaneous finishing, marking, and entwining of the fiber slivers 1 in the common sliver funnel 22 with appropriately enriched air jets, it is also possible to provide a separate sliver funnel 22 that can be supplied with the finishing and/or marking agents via appropriate annular channels 26, 28 and nozzles 25, 27.

The supply of compressed air to the sliver funnel 22 is effected via air supply lines 32, 33 that are illustrated in FIG. 1. The two air supply lines 32, 33 come from a common air supply 34, which is also shown in FIG. 1.

Both the air supply 8 for the splicing mechanism 2 as well as the air supply 34 for the entwining mechanism 3 can be connected to a common source for compressed air.

In a disturbance-free process, the air supply 8 for the splicing mechanism 2 is closed, and compressed air is supplied only to the air supply 34 for the entwining mechanism 3, so that only the latter operates. If the fiber sliver 1 breaks, the action of the entwining mechanism 3 is interrupted by closing the air supply 34, and compressed air is supplied to the air supply 8 for the splicing mechanism 2, so that the ends of the fiber slivers 1 can be spliced together in the manner previously described. Supply of the air supply 8 for the splicing mechanism 2 is effected by a pedal-operated valve. After the rod 4 of the splicing mechanism 2 is again folded up into the rest position, the air supply 8 is closed and the air supply 34 to the entwining mechanism 3 is reopened, so that the normal processing can be started again and can be carried out.

The combination apparatus was described in conjunction with fiber slivers. However, just like these fiber slivers, filament cables or tows must be adequately held together. Thus, tows placed in bales or cartons must, for further processing, be able to be pulled out of the bales or cartons without separating and without entangling with other tows due to separation. The requirements also concern tow withdrawal for the further treatment during the manufacture of man-made fibers (for example fiber-cutting machines) or in the spinning plant and for the finisher (for example tow-dying apparatus, stretch-break converter).

The holding-together required for a trouble-free further processing of filament tows is achieved in practice by the addition of suitable finishing agent and by appropriate crimping. However, not all untreated fiber material can be sufficiently crimped (for example viscose tow), and furthermore a high degree of crimping is not always desired.

For this reason, the entwining mechanism 3 described above can be used analogously for tows, for example between a tow dryer and a crimping chamber during the manufacture of man-made fibers. This offers the possibility of eliminating a high degree of crimping, while nonetheless assuring the required sliver cohesion of the tow.

The present invention is, of course, in no way restricted to the specific disclosure of the specification and drawings, but also encompasses any modifications within the scope of the appended claims.

What I claim is:

1. In a combination apparatus for selectively splicing the ends of fiber slivers, or entwining fiber slivers, said apparatus including a splicing mechanism having one or more pairs of nozzles that are disposed on a pair of nozzle supports in such a way that said nozzles are spaced from one another and are directed in opposed directions, said nozzles being adapted to be supplied with compressed air, with splicing of the ends of said fiber slivers being effected by aerodynamic turbulence, and also including an entwining mechanism that is disposed downstream of said splicing mechanism and has a sliver funnel that has a tapering cross-sectional transport surface, with the fiber sliver, which comprises individual fibers that are oriented essentially parallel to one another, being guided through said sliver funnel, the improvement wherein:

said nozzle support arrangement of said splicing mechanism comprises essentially round rods that are adapted to be disposed horizontally one above the other, with said nozzles of said splicing mechanism opening on surfaces of said rods via nozzle outlets that are surrounded by respective raised portion means of said rods;

a guide mechanism is disposed upstream of said sliver funnel of said entwining mechanism for converting and bringing said fiber slivers into a substantially flat sliver form, with said guide mechanism comprising the lowermost one of said horizontal rods, upon which said fiber slivers rest, plus two vertical guide rods that are disposed to the sides; and at least two pairs of further nozzles, with said nozzle pairs being successively disposed in said sliver funnel at a distance from one another and in a crosswise manner relative to each other, and with the nozzles of each pair of further nozzles being directed in opposed directions and being adapted to be supplied with compressed air.

2. A combination apparatus according to claim 1, in which each of said horizontal rods of said splicing mechanism is provided with an axial air supply channel that is connectable to a supply of compressed air; and in which said nozzles of said splicing mechanism are disposed in said horizontal rods and proceed in a radial direction from said air supply channels.

3. A combination apparatus according to claim 2, in which each of said horizontal rods has a single raised portion means for all of the nozzle outlets of said nozzles of that horizontal rod, with all of said nozzle outlets opening within said single raised portion means.

4. A combination apparatus according to claim 3, in which each of said raised portion means is a recess that is provided on the surface of the associated horizontal rod, and into which said nozzle outlets of said nozzles of that associated horizontal rod open.

5. A combination appartus according to claim 4, in which each of said recesses has a trough-like, hemispherical, or groove-like shape.

6. A combination apparatus according to claim 3, in which each of said raised portion means is a raised edge that is provided on the surface of the associated horizontal rod, and that surrounds said nozzle outlets of said nozzles of that horizontal rod.

7. A combination apparatus according to claim 3, in which the uppermost one of said horizontal rods is disposed on a pivot mechanism.

8. A combination apparatus according to claim 1, in which said vertical guide rods are adjustably mounted to permit alteration of the cross-sectional shape of said fiber slivers.

9. A combination apparatus according to claim 1, in which each of said pairs of further nozzles in said sliver funnel is formed by a plurality of nozzles.

10. A combination apparatus according to claim 9, in which said sliver funnel is provided with two pairs of further nozzles, with a first one of said nozzle pairs being disposed near the upstream side of said sliver funnel and having its nozzles discharge in the transverse plane of said fiber slivers, and with a second one of said nozzle pairs being disposed downstream of said first pair and having its nozzles discharge at right angles to said transverse plane of said fiber slivers.

11. A combination apparatus according to claim 10, in which said further nozzles of each of said nozzle pairs in said sliver funnel are slightly offset relative to one another.

12. A combination apparatus according to claim 11, in which said sliver funnel is provided with annular channels that are connectable to a supply of compressed air and lead to said further nozzles.

13. A combination apparatus according to claim 12, in which said sliver funnel, for the discharge of air supplied thereto, is provided with air-outlet bores that are disposed downstream of said nozzle pairs.

14. A combination apparatus according to claim 13, in which each of said air-outlet bores has a diameter of from 3 to 15 mm.

15. A combination apparatus according to claim 14, in which each of said further nozzles of said sliver funnel has a bore diameter of from 0.5 to 4 mm.

16. A combination apparatus according to claim 15, in which said bore diameter of said further nozzles is from 1 to 2 mm.

17. A combination apparatus according to claim 1, in which said splicing mechanism and said entwining mechanism are connected to a common supply of compressed air, with said compressed air being at a pressure of from 1 to 4 bar.

* * * * *